United States Patent [19]

Pelda et al.

[11] Patent Number: 4,523,834

[45] Date of Patent: Jun. 18, 1985

[54] DRY TONER REPLENISHING APPARATUS

[75] Inventors: Frederick J. Pelda, White Plains, N.Y.; Roderick N. Schmaling, Brookfield Center, Conn.

[73] Assignee: Pitney Bowes Inc., Stamford, Conn.

[21] Appl. No.: 569,353

[22] Filed: Jan. 9, 1984

[51] Int. Cl.[3] ..... G03G 15/08

[52] U.S. Cl. ..... 355/3 DD; 355/14 D; 222/DIG. 1; 222/553

[58] Field of Search ..... 355/3 DD, 14 D; 222/DIG. 1, 553, 556, 557

[56] References Cited

U.S. PATENT DOCUMENTS

| | | | |
|---|---|---|---|
| 3,356,248 | 12/1967 | Del Vecchio | 222/553 X |
| 3,501,065 | 3/1970 | Altmann et al. | 222/DIG. 1 |
| 3,999,654 | 12/1976 | Pollack | 222/DIG. 1 |
| 4,089,601 | 5/1978 | Navone | 355/3 DD X |
| 4,293,085 | 10/1981 | Nakajima et al. | 355/3 DD X |
| 4,391,503 | 7/1983 | Pugh | 355/3 DD |
| 4,435,065 | 3/1984 | Wada | 355/3 DD |

*Primary Examiner*—A. C. Prescott

*Attorney, Agent, or Firm*—Lawrence E. Sklar; William D. Soltow, Jr.; Albert W. Scribner

[57] ABSTRACT

A dry toner replenishing apparatus is provided for periodically replenishing dry toner into a storage receptacle of a copying machine. The apparatus includes a toner material supply container adopted to be removably received within an opening in the copier for dispensing developing material into the storage receptacle. The supply container has a dispensing opening and a closure device normally closing the opening. A cooperating connecting structure on the copying machine limits pivotal movement of the supply container between an insertion and a dispensing position, and a device on the copying machine engages the closure device on the supply container to open the closure device during movement of the supply container from the insertion position to the dispensing position.

6 Claims, 6 Drawing Figures

DRY TONER REPLENISHING APPARATUS

BACKGROUND OF THE INVENTION

1. Field of the Invention

This invention relates generally to the field of electrostatic copying machines of the type which utilize a dry toner developing material to render visible an electrostatic latent image produced on a photoconductive recording medium. More particularly, the invention relates to an apparatus for periodically replenishing the supply of the dry toner developing material stored in the copying machine where the supply of developing material has been depleted to a low volume from normal use of the copying machine.

As is well known in the field today, the typical electrostatic copying machine which operates on the xerographic process includes a photoconductive member on which a latent electrostatic charge image of graphic information on an original document is created by selective discharge of a uniformly charged photoconductive member. The latent image is rendered visible by applying thereto a suitable electrostatic marking material such as dry toner developing material, after which the visible toner image is transferred to a sheet of paper and is permanently affixed thereto by suitable means, usually heating.

The developing material used in most present day electrostatic copying machines consists of a very finely ground carbon base powder which is extremely difficult and messy to handle, and is difficult to clean from machine parts, hands and clothing. Because of its very fine nature, it is difficult to pour from a bottle because it bridges at the neck of the bottle, thereby requiring a certain degree of shaking or rolling of the bottle or other agitation of the powder. In addition, pouring dry toner powder from a bottle or package into the storage receptacle of a copying machine is undesirable for the reason that inevitably carbon toner dust rises as a cloud and both settles on adjacent machine parts and is carried out into the room through vent fans or other openings. As toner dust accumulates on the mirrors and lenses of the optical system in the copying machine, the quality of the copy degrades and ultimately becomes unacceptable if these machine parts are not periodically cleaned. Further, any accumulation of toner dust, even in minute quantities, in any of the sensitive electronic control components of the copying machine can easily result in malfunctioning of the machine which normally requires servicing beyond the capability of the operator. Also, toner which may either contact an operator's hands or get on his clothing is very difficult to remove and often permanently stains certain materials. Another serious problem is that the toner dust, if inhaled in even small amounts, may cause respiratory tract irritation resulting in coughing and sneezing, which may have serious consequences for anyone with chronic respiratory conditions.

It is apparent from the foregoing that there exists a variety of troublesome and in some cases serious problems which result from handling dry toner developing materials in a conventional manner, such as by pouring directly from a bottle into the toner storage receptacle of the copying machine. Nevertheless, because of the gradual consumption of the developing material during the copying process it must be periodically replenished.

2. The Prior Art

The most common solution to the above problems is to provide a containerized system for periodically replenishing the dry toner developing material. There are generally two types of containerized systems currently in use, in one of which the toner material is stored in a bottle or other container mounted in a suitable receptacle, and a dispensing device is provided in the bottle or other container for metering the flow of toner material from the bottle to a storage receptacle in the copying machine at a suitable rate depending upon the rate of consumption of the toner material during the copying operation. Such a system is shown in U.S. Pat. No. 3,853,246, a principal disadvantage of which is the relatively high expense of the bottle with the dispensing device therein, since the bottle is not reused after it becomes empty.

The other and more preferable type of containerized system, as shown in U.S. Pat. Nos. 4,237,943 and 4,304,273 includes a container having suitable means for sealing the toner material therein until it is ready for use, the container and copying machine having cooperating means for mounting the container on the copying machine so that the toner merely falls by gravity into a storage receptacle in the copying machine. Preferably the sealing means is such that it is removed after the toner bottle is in place in a dispensing position. One disadvantage with the system shown in the U.S. Pat. No. 4,237,943 is that it is necessary to physically handle a closure member which is in contact with toner material in order to open the container, thus leaving the possibility that some toner may be deposited on machine parts or the hand or clothing of an operator.

A significant disadvantage of the device shown in the U.S. Pat. No. 4,304,273 is that the dispensing opening from the bottle is so small that the developing material has a tendency to bridge thereby requiring agitation of the bottle which tends to raise a cloud of developing material which settles on adjacent machine parts.

SUMMARY OF THE INVENTION

The present invention either obviates or substantially eliminates the aforementioned problems and disadvantages of both manual toner material replenishing methods and the containerized toner material replenishing systems shown in the referenced patents as well as others which are in practice. The present invention achieves this by providing a toner material container which is normally sealed prior to use, is automatically unsealed and opened for dispensing in the course of being inserted into the copying machine and moved to a dispensing position, and promptly dispenses all of its contents by gravity flow into a storage receptacle in the copying machine which is sufficiently enclosed to prevent a cloud of toner dust for rising from the receptacle. Thus, the toner material is totally confined at all times, and there are no toner contaminated parts of the container which must be handled by the operator.

To this end, the present invention, in its broader aspect, is an apparatus for periodically replenishing dry toner developing material into a storage receptacle of a copying machine and comprises an opening in one end of the copying machine and a toner material supply container adapted to be removably received within the opening for dispensing developing material into the storage receptacle, the supply container having a dispensing opening and a closure device normally closing the opening. There is cooperating connecting structure located on the copying machine and on the supply container for removably connecting the supply container to the copying machine for limited pivotal movement of the supply container between an insertion position and a dispensing position, and a device on the copying machine engages the closure device on the supply container so as to open the closure device during movement of the supply container from the insertion position to the dispensing position.

In some of its more limited aspects, the closure device preferably includes a frangible sealing member which normally seals the closure device and which is broken in response to the supply container being inserted into the opening in the copying machine. Also, the cooperating connecting structure is arranged such that the supply container is locked into the opening in the copying machine and cannot inadvertently be removed therefrom after the supply container is pivotally moved away from the insertion position.

Having briefly described the general nature of the present invention, it is a principal object thereof to provide a dry toner developing material replenishing apparatus for an electrostatic copying machine which avoids the aforementioned problems and disadvantages of prior art toner replenishing systems and which affords novel features and advantages not heretofore achieved.

It is another object of the present invention to provide a dry toner developing material replenishing apparatus in which toner material is handled in a sealed container and is dispensed into a copying machine without the requirement that an operator handle any parts which have been in contact with the toner material.

It is yet another object of the present invention to provide a dry toner developing material replenishing apparatus in which a sealed container holding the developing material is locked into the copying machine once the seal is broken so that it cannot be inadvertently withdrawn during dispensing, thereby further avoiding any possibility of spilling toner material on the operator or on adjacent machine parts.

These and other objects and advantages of the present invention will be more apparent from an understanding of the following detailed description of a presently preferred embodiment of the invention, taken in conjunction with the accompanying drawings in which.

Figure 4A:
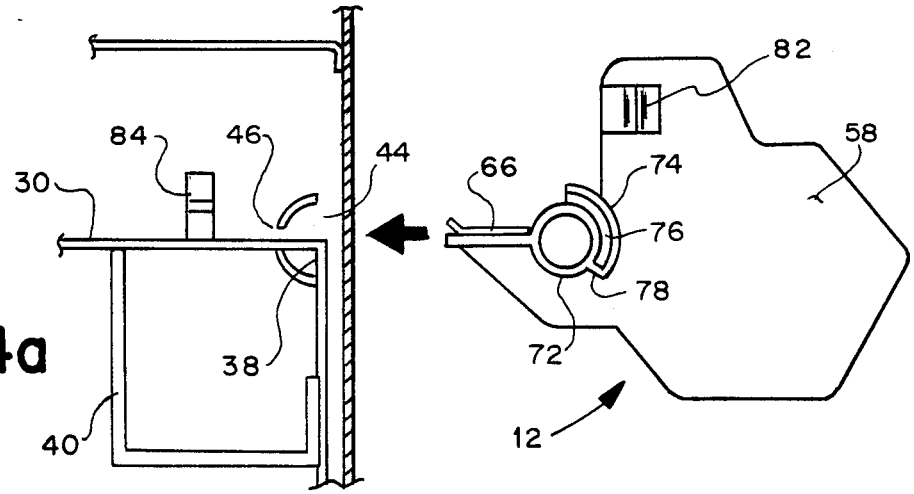
Figure 4B:
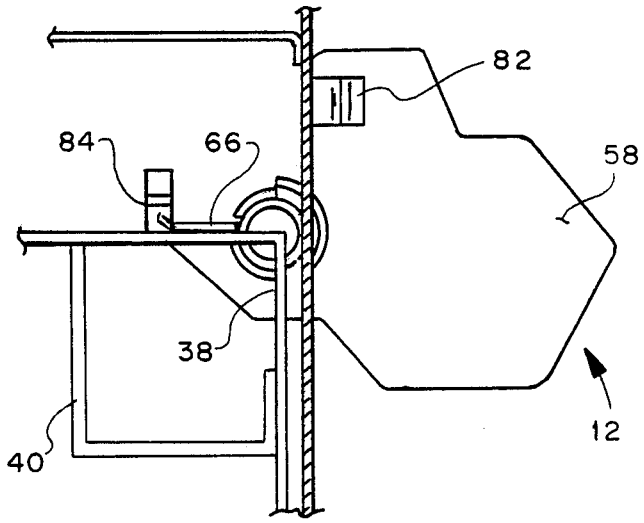
Figure 4C:
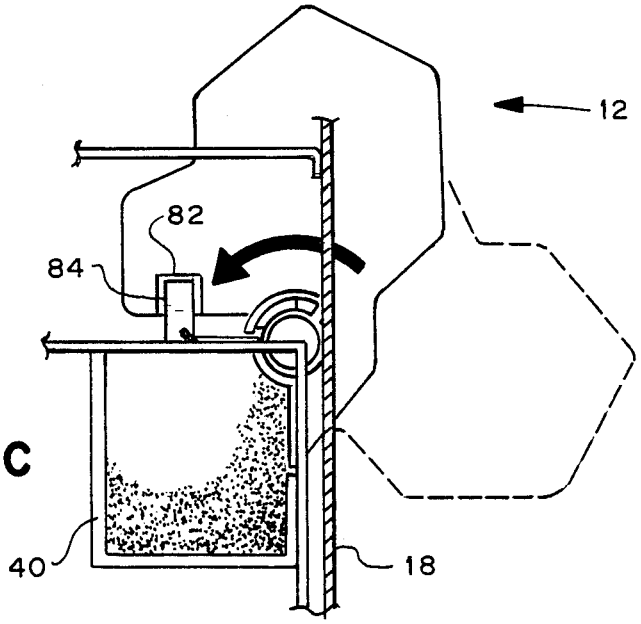

FIGS. 4*a*, 4*b* and 4*c* are side views showing the developing material apparatus with the supply container in a pre-insertion position, the insertion position and the dispensing position.

DETAILED DESCRIPTION OF THE INVENTION

Figure 1:
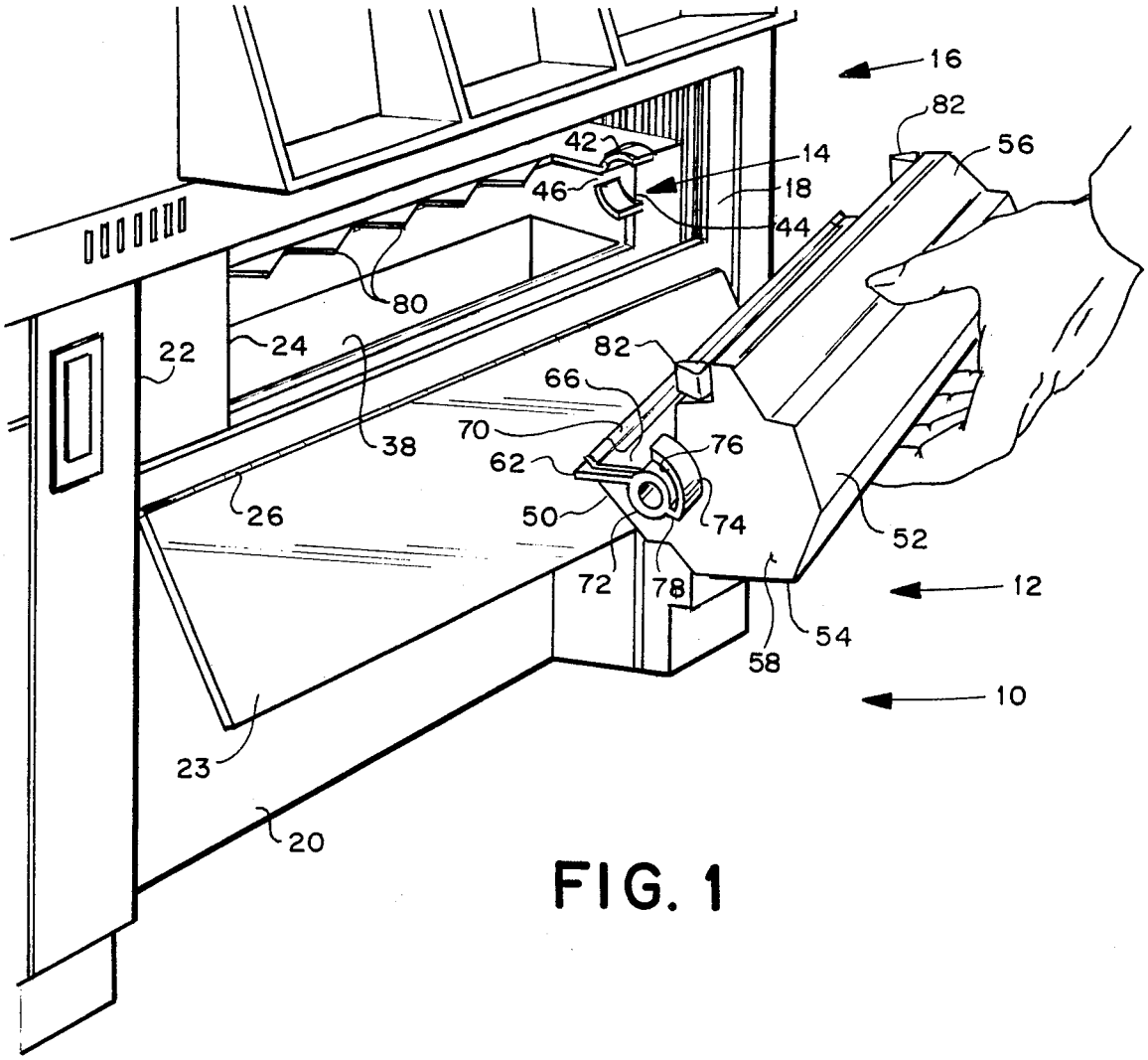
FIG. 1 is a perspective view of the dry toner developing material replenishing apparatus showing the developing material supply container about to be inserted into the copying machine.

Referring now to the drawings, and particularly to FIG. 1 thereof, there is seen a dry toner developing material replenishing apparatus generally designated by the reference numeral 10. The apparatus 10 generally comprises a developing material supply container generally designated by the reference numeral 12 and a supply container receiving structure generally designated by the reference numeral 14 mounted adjacent one end of an electrostatic copying machine generally designated by the reference numeral 16.

With greater particularity, the copying machine 16 typically includes a frame 18 on which all of the operating instrumentalities of the copying machine are mounted, and the entire machine is enclosed within suitable housing panels of which only an end panel 20 is shown. The end panel 20 defines an opening 22 which is normally covered by a door 23 connected to the panel 20 by a hinge 26. The opening 22 provides access to an end portion of the frame 18 which defines another opening 24 into which the toner material supply container 12 is adapted to be removably received.

Figure 2:
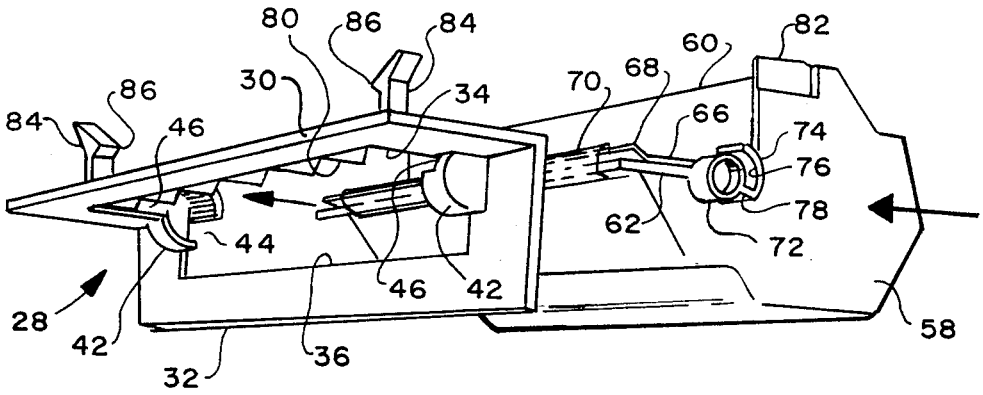
FIG. 2 is a fragmentary perspective of the apparatus shown in FIG. 1 but seen from the opposite direction.

There is provided cooperating connecting means on the frame 18 adjacent the opening 24 and on the supply container 12 for removably connecting the supply container to the frame for dispensing toner material from the supply container 12 into a storage receptacle in the copying machine. With reference to FIGS. 1 and 2, a partition member generally designated by the reference numeral 28 is suitable mounted on the frame 18, the partition member 28 having a horizontal wall portion 30 and a vertical wall portion 32, each of these wall portions having cut out portions 34 and 36 respectively which together define an opening 38 into which a portion of the supply container moves in a manner to be made clear hereinafter. With reference to FIG. 4 it will be seen that a toner material storage receptacle 40 is suitably mounted on the frame 18 directly beneath the opening 38.

Referring again to FIGS. 1 and 2, it will be seen that a pair of substantially semi-circular walls 42 are mounted on the partition member 28 adjacent the intersection of the horizontal and vertical wall portions 30 and 32 and adjacent the edge of the cut outs 34 and 36. The walls 42 are each provided with an outwardly facing gap 44 and an inwardly facing slot 46 by which the supply container 12 is removably and pivotally mounted on the partition member 28 in a manner to be described below.

Although the specific configuration of the supply container is not critical to the invention in the embodiment disclosed, it comprises generally a forward wall 50, a rearward wall 52, a bottom wall 54 and a top wall 56, these walls being connected by an end wall 58 (disposed at both ends). It will be seen that a quadrant of the container has been omitted or cut away to define a recessed front wall 60 (FIG. 2) and a horizontal frame portion 62 which defines a dispensing opening 64 (FIG. 3) through which toner material can flow. A flap 66 is suitably connected to the container 12 adjacent the intersection of the recessed front wall 60 and the frame portion 62 so as to form a closure means for the dispensing opening 64. The flap 66 has an upturned lip 68 extending along the entire length of the flap 66, and a suitable frangible member 70, such as a strip of cellophane tape or metal foil, (of which only a portion is shown) extends across the lip 68 and the frame portion 62 to secure the flap 66 to the frame 62 to seal the supply container when it is not in use. This assures that the toner material cannot be inadvertently spilled during handling of the supply container 12.

In order to pivotally connect the supply container 12 to the partition member 28, a pair of circular protrusions 72 are disposed on the side walls 58 adjacent the intersection of the recessed front wall 60 and the frame portion 62, the protrusions having a diameter and arcuate configuration such that they will pass through the gaps 44 and mate with the walls 42 when the supply container is inserted into the opening 24. Each protrusion 72 is partly surrounded by a concentrically spaced arcuate wall 74 thereby defining an arcuate slot 76 which terminates in a radial wall 78. The arrangement is such that when the supply container 12 is fully inserted into the opening 24, the protrusions 72 seat within the walls 42 to form a pivot hinge, and as soon as the supply container 12 is tilted upwardly from the insertion position, the walls 74 on the supply container 12 extend over the walls 42 on the partition member 28, the latter then riding in the slots 76 as shown in FIG. 4*c*. The supply container 12 is thereby pivotably locked into engagement with the partition member 28 over the supply container 12 and is moved away from the insertion position shown in FIG. 4*b* toward the dispensing position shown in FIG. 4*c*.

Means are provided for automatically braking the frangible element 70 as the supply container 12 is inserted into the opening 24 and for also causing the flap 66 to be opened so that the operator does not have to perform either of these operations thereby avoiding any possibility of spillage or contact with the toner material. During insertion of the supply container 12, the side edges of the frame portion 62 pass through the slots 46, thereby providing a guiding means to assist in properly locating the toner supply container 12 within the opening 24. This is important in order to assure that the frangible element 70 is broken and the flap 66 is opened. It will be seen that a plurality of sharp teeth 80 are formed on the horizontal wall 30 of the partition member 28 which face outwardly in the cut out 34. The teeth 80 pierce the frangible member 70 and engage the under side of the raised lip 68 as the supply container 12 is inserted into the opening 24. When the supply container is fully inserted into the opening 24 and is in a first or insertion position as shown in FIG. 4*b*, the teeth 80 and a portion of the horizontal wall 30 are disposed underneath the flap 66. Also, the protrusions 72 are fully seated within the circular walls 42.

Figure 3:
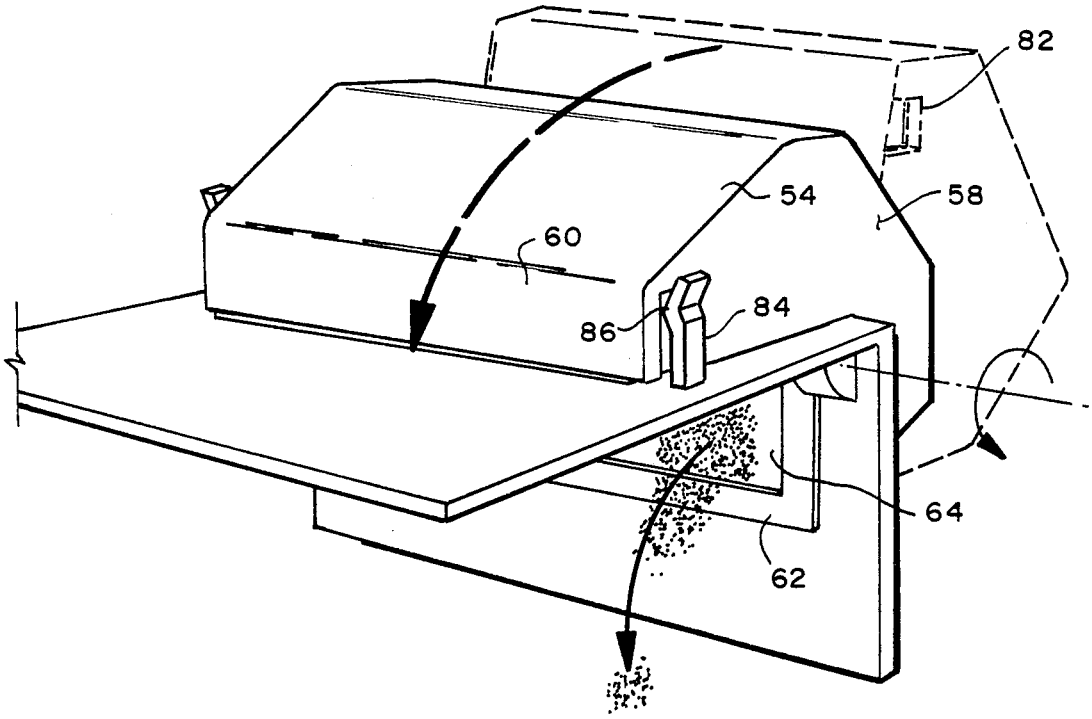
FIG. 3 is a perspective view similar to FIG. 2, drawn to an enlarged scale, showing the developing material supply container in the dispensing position.

In order to prevent accidental dislodgment of the supply container 12 from its dispensing position shown in FIGS. 3 and 4*c*, a retaining means is provided which comprises a pair of wedge shaped detents 82 formed on the side walls 58 adjacent the intersection of the side walls 58 with the recessed front wall 60. Also, the partition member 28 is provided with a pair of upstanding spring tabs 84 each having a protrusion 86 which is adapted to engage with the detents 82 in the manner as shown in FIG. 3 when the supply container 12 is moved to the dispensing position as shown in this figure and in FIG. 4*c*.

In operation, when it is desired to replenish toner material in the copying machine, the operator procures a toner supply container 12, opens the door 23 of the copying machine and inserts the supply container into the opening 24 with the frame portion 62 of the supply container 12 forward. As the supply container 12 is moved toward a fully inserted position, the teeth 80 brake the frangible element 70 and pass between the raised lip 68 and the frame portion 62 so as to be disposed on the underside of the flap 66 when the supply container is fully inserted. In the position the protrusions 72 are seated in the walls 42 and the supply container 12 is then tilted upwardly in the direction of the arrow shown in FIG. 4*c*, during which movement the flap 66 is held stationary by the teeth 80 and the wall portion 30, thereby exposing the dispensing opening 64 so that the toner material falls by gravity from the supply container 12 into the storage receptacle 40. Also, the supply container is removably locked in this position by the engagement of the detents 82 with the spring latches 84 so that it cannot inadvertently return to the original position and fall out of the copier. When the supply container is empty, it is rotated back to the insertion position, removed from the copying machine and discarded without the operator having contacted or been exposed to the toner in any way and without any toner having been spilled or otherwise deposited on any part of the copying machine.

What is claimed is:

1. In a xerographic copying machine having a frame and instrumentalities mounted therein for making xerographic copies of original documents, one of said instrumentalities being a dry toner developing apparatus which utilizes dry toner developing material stored in a storage receptacle located adjacent one end of said frame, apparatus for periodically replenishing dry toner developing material into said storage receptacle, said apparatus comprising:

A. an aperture defined by a portion of said frame adjacent said one end of said frame, B. a toner material supply container adapted to be removably received within said opening for dispensing developing material into said storage receptacle, said supply container having a dispensing opening and closure means normally closing said dispensing opening, C. cooperating connecting means on said frame adjacent said aperture and on said supply container for removably connecting said supply container to said frame for limited pivotal movement of said supply container with respect to said frame between first and second positions in the latter of which said dispensing opening overlies said storage container, and D. means mounted on said frame for engaging said closure means where said supply container is inserted into said opening and is in said first position and for opening said closure means during pivotal movement of said supply container from said first position to said second position, whereby dry toner developing material in said supply container is dispensed by gravity flow through said dispensing opening into said storage receptacle.

2. Apparatus as set forth in claim 1 wherein

A. said closure means on said supply container includes a frangible member normally sealing said closure means, and B. said engaging means on said frame includes means for breaking said frangible member while said supply container is being inserted into said opening.

3. Apparatus as set forth in claim 2 wherein

A. said closure means on said supply container further comprises a flap pivotably connected to said supply container adjacent said dispensing opening, said flap normally being maintained in closed position by said frangible means to prevent spillage of development material during handling of said supply container, and B. said engaging means on said frame further includes means for engaging said flap when said container is inserted into said opening to said first position and for holding said flap stationary during said pivotal movement of said supply container from said first position to said second position.

4. Apparatus as set forth in claim 1 wherein said cooperating connecting means comprises means for preventing removal of said supply container from said aperture where said supply container is moved away from said first position.

5. Apparatus as set forth in claim 1 wherein said connecting means comprises mutually engaging rotary locking means which are engagable when said supply container is inserted into said aperture in said first position and which cannot be disengaged during movement of said supply container between said first and second positions.

6. Apparatus as set forth in claim 5 wherein said mutually engaging rotary locking means comprises:

A. a protrusion extending outwardly from each side wall of said supply container, and an arcuate wall segment extending around a portion of each of said protrusions facing away from said opening when said supply container is being inserted therein, and B. a pair of arcuate wall segments mounted on said frame on each side of said aperture, said pairs of wall segments forming a pair of outwardly facing sockets for receiving said protrusions, and first named arcuate wall segments extending around the outer surface of said second named wall segments in order to lock said protrusions into said sockets.

* * * * *